United States Patent [19]

Cunningham

[11] Patent Number: 4,858,314

[45] Date of Patent: Aug. 22, 1989

[54] DISPENSING CAP FOR SHAVING LUBRICANT

[75] Inventor: William J. Cunningham, Allamuchy Township, Warren County, N.J.

[73] Assignee: Topaz Development Corp., Flemington, N.J.

[21] Appl. No.: 199,436

[22] Filed: May 27, 1988

[51] Int. Cl.[4] ..... B26B 21/40

[52] U.S. Cl. ..... 30/90; 30/41

[58] Field of Search ..... 30/41, 90, 85, 86; 222/95, 96

[56] References Cited

U.S. PATENT DOCUMENTS

| | | | |
|---|---|---|---|
| 1,849,841 | 2/1933 | Acken | 30/90 |
| 3,754,326 | 8/1973 | Glaberson | 30/90 |
| 3,783,511 | 1/1974 | Pass | 30/41 |
| 4,023,269 | 5/1977 | Lopez | 30/41 |
| 4,077,119 | 3/1978 | Sellera | 30/41 |
| 4,656,738 | 4/1987 | Corah | 30/41 |

*Primary Examiner*—Douglas D. Watts

*Attorney, Agent, or Firm*—Kenneth P. Glynn, Esq.

[57] ABSTRACT

The present invention is directed to a dispensing cap for shaving lubricant which may be attached to a tube containing shaving lubricant or may be an integral part thereof. Thus, the device is a carrier for a lubricant for shaving in that it is uniquely adapted for supplying shaving lubricant directly to the razor blade of a razor. The present invention dispensing cap, in one embodiment, includes a neck having attachment means adapted for connection to the open end of a tube of shaving lubricant, the neck having a channel for the lubricant to pass through; and includes a receiving head opposite the neck which includes:

i. an inside hollow area connected to the channel of said neck and adapted to receive a supply of shaving lubricant;

ii. an outside, recessed area having a width greater than the width of a razor adapted to nest at least the blade end of a razor; and, iii. a lubricant distribution means adapted to distribute lubricant from a supply of lubricant of the inside hollow area, including a manifold located at the blade end nesting portion of said recessed area.

In an alternative embodiment, the dispensing cap has the features mentioned, but instead of being attachable to a tube of shaving lubricant, the cap is integrally formed with and as a part of a tube of shaving lubricant.

16 Claims, 3 Drawing Sheets

DISPENSING CAP FOR SHAVING LUBRICANT

BACKGROUND OF THE INVENTION

1. Field of the Invention

The present invention relates generally to means for dispensing shaving lubrication from a container. More specifically, it relates to a self-contained dispensing cap with provision for the direct application of shaving lubricant from a container to which the cap is attached or is an integral part thereof, to the blade of the razor. Thus, the present invention relates to a single device which enables a shaver to avoid the necessity of applying shaving lubricant to the face by hand.

2. Prior Art Statement

It has been recognized that the preparation of body hair for shaving, by the application of lather or shaving cream with a brush or by hand can be expensive and time consuming. Further, the lather or cream may run if too wet or may dry up before the shaving razor gets to the particular area to be shaved. Also, the lather or cream is wasted or lost on the applicator, the hand and/or areas of the body peripherally to the area to be shaved.

One development made in response to the foregoing was the shaving cream-containing razor. In some systems the shaving cream was carried in a hollow handle and applied as needed. In others, the lubricant was located on or in the head of the razor. Many patents have issued on small variations on these ideas and the art is replete with detailed features.

Exemplary of the patents showing shaving cream dispensers in the handle position of a razor are U.S. Pat. Nos. 3,412,465; 3,783,511; 4,023,269; 4,077,119; 4,228,587 and 4,562,643. These patents call for various handle replacements, handle modifications or handle designs which require either a very small volume or a very large or even huge handle. Thus, the amount of shaving cream is very small for a normal size handle or, in the alternative, for any significant amount of shaving cream or lubricant to be present, a very bulky design is required which is heavy and, most significantly, awkward to use. In either case, there is an inherent disadvantage to the use of the handle as the shaving medium carrier due to the size of the handle versus the size of the hand. Also, many of these patents are directed to dispensing the shaving medium to the surface to be shaved and not the razor edge. Only U.S. Pat. No. 4,077,119 provides cream to the blade, but this device is extremely limited in volume and optional carriers as it requires a pressurized cartridge and this must be small enough to fit into a handle, as shown.

Other patents illustrate shaving lubricant application via holders or configurations which attach to or near the razor blade for direct application to the face during shaving. Thus, U.S. Pat. No. 3,895,437 shows a moisturizing device attached to a razor handle with a pivoting lubricant applicator which swings into position near the blade during use. U.S. Pat. No. 4,074,429 likewise shows a moisturizing device attached to a handle and blade with a pad or bar that applies soapy lather directly to the face and U.S. Pat. No. 4,562,644 shows a lubricant roller which applies lubricant near the blade during use. U.S. Pat. No. 4,170,821 describes a lubricating strip attached to a blade cartridge. One of these patents are directed to applying the lubricant directly to the blades before use and all rely upon direct attachments to the razor handle which again create bulk, weight and get in the way of various shaving stroke maneuvers which are normally performed during shaving.

SUMMARY OF THE INVENTION

The present invention is directed to a dispensing cap for shaving lubricant which may be attached to a tube containing shaving lubricant or may be an integral part thereof. Thus, the device is a carrier for a lubricant for shaving in that it is uniquely adapted for applying shaving lubricant directly to the razor blade of a razor. The present invention dispensing cap, in one embodiment, includes a neck having attachment means adapted for connection to the open end of a tube of shaving lubricant, the neck having a channel for the lubricant to pass through; and includes a receiving head opposite the neck which includes:

i. an inside hollow area connected to the channel of said neck and adapted to receive a supply of shaving lubricant;

ii. an outside, recessed area having a width greater than the width of a razor adapted to nest at least the blade end of a razor; and, iii. a lubricant distribution means adapted to distribute lubricant from a supply of lubricant of the inside hollow area, including a manifold located at the blade end nesting portion of said recessed area.

In an alternative embodiment, the dispensing cap has the features mentioned, but instead of being attachable to a tube of shaving lubricant, the cap is integrally formed with and as a part of a tube of shaving lubricant.

BRIEF DESCRIPTION OF THE DRAWINGS

The present invention objects and advantages will become more apparent when taken in conjunction with the accompanying Figures wherein.

DETAILED DESCRIPTION OF THE INVENTION AND DRAWINGS

As mentioned above, some of the cited prior art is directed to application of the shaving cream to the face just before the blade reaches the area, but relies upon a source that must constantly be held during shaving. Some prior art is concerned with compactness and, even though the razor and cream are in a single device, the cream is applied to the hand for face in a separate step. One cited prior art patent does call for some cream to be applied directly to the blade but does so with a small source in the handle and still permits some of the cream to flow out of a port in the back of the razor.

The inventors herein having surprisingly discovered that the key to an exceptionally good shave, one that is superior to conventional techniques, involves applying the lubricant to the blade before stroking the surface of the face to have a gliding, smooth, close shave. Further, to avoid the random shot approach to applying cream, the present invention device was developed which directly and by intentional design evenly applies the lubricant to blade for shaving, and acts as a single razor and lubricant carrier.

As used herein, "lubricant" is meant to include any shaving medium which assists in softening the skin, standing up whiskers, adding gliding ability to the razor, reducing nicks and pulls or otherwise enhancing a shave and has flowability. Thus, "lubricant" as used herein means shaving cream, shaving gel, soap, foam, viscous oils, soapy solutions and the like, with or without surfactants, fragrances, alcohols and other additives.

Figure 1:
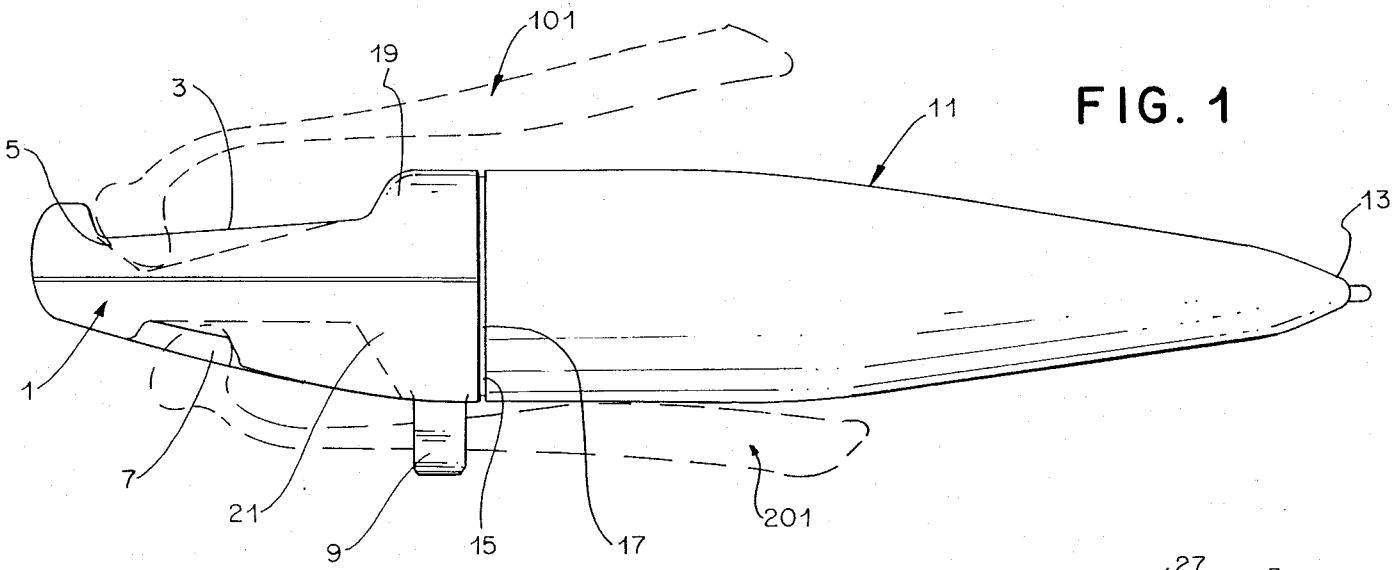
FIG. 1 illustrates a side view present invention dispenseing cap and shaving lubricant tube.

Referring now to FIG. 1, there is shown a side view of dispensing cap 1 and a shaving lubricant tube 11. Dispensing cap 1 includes a neck 23 which has attachment means more fully illustrated below in conjunction with FIG. 2. Shaving lubricant tube 11 may contain any shaving lubricant, as defined above, and is generally flexible and includes, in addition to tube neck 17, located at tube top end 15, a tube bottom end 13, as shown. The dispensing cap 1 has an optional feature which consists of razor handle holder 9 (left side) and razor neck 7 adapted to receive and hold for storage a standard razor such as is shown by dotted line razor 201. FIG. 1 also shows dotted line razor 101 in the operational position for dispensing of the shaving lubricant from the tube 11 and through dispensing cap 1 to the blade of razor 101.

Figure 3:
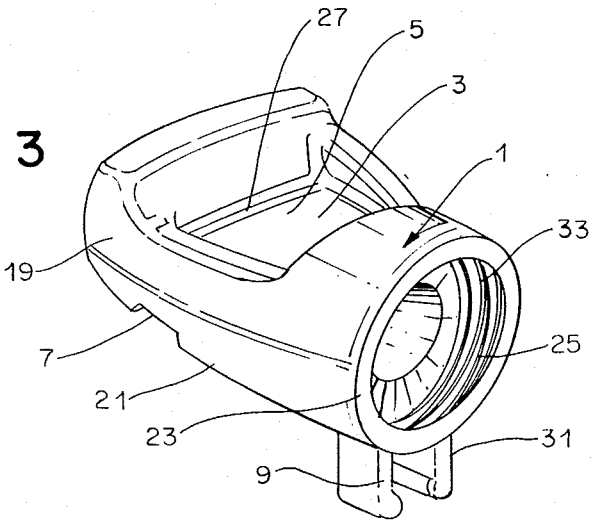
FIGS. 2, 3, and 4 illustrate a side cut view, a perspective view and a top view of a present invention dispensing cap adapted for attachment to a tube of shaving lubricant.
Figure 2:
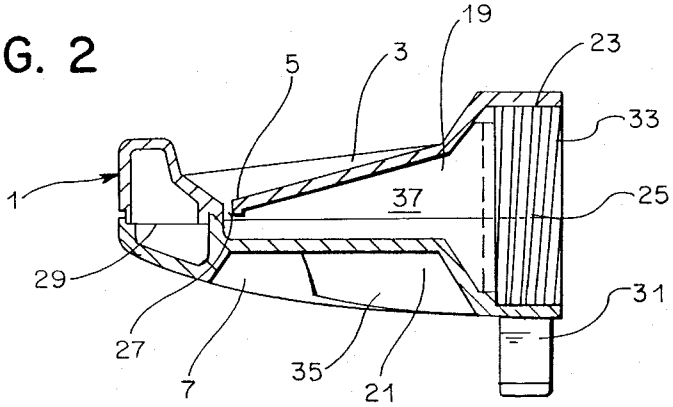
Figure 4:
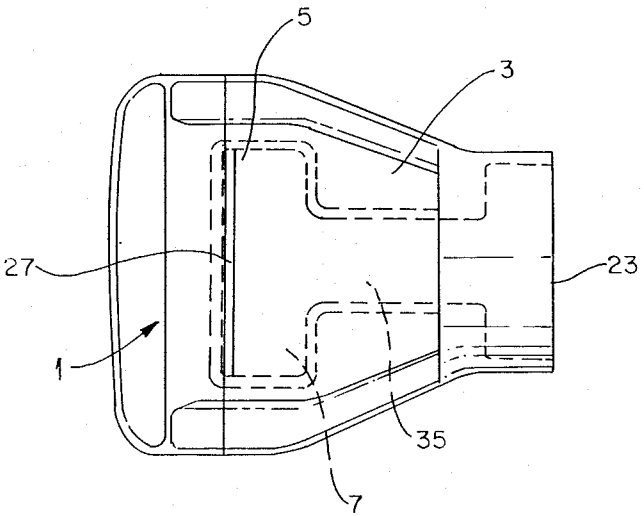

Again referring to FIG. 1 but now also referring to FIGS. 2, 3 and 4, note that FIGS. 2, 3 and 4 show cut side perspective and top views of dispensing cap 1. Tube neck 17 has threads which are not shown and dispensing cap 1 is attached thereto via attachment means, in this case threads 25, located within cap neck 23. Neck 23 has a shaving lubricant inlet channel known as channel 33 which, in this case is rather large but may be adapted for any size threading or even other type of attachment means to a tube of shaving lubricant. Dispensing cap 1 has recessed tray 3, which is sloped as shown and has a razor receiving portion 5 located at the lower end or forward end of recessed tray 3. There is a cap lubricant channel 37 through which shaving lubricant passes when tube 13 is squeezed. The lubricant exits through lubricant dispensing channel port 27 for direct application to a razor such as razor 101.

Also as shown in most of the Figures herein, including FIGS. 1, 2, 3, 6 and 8, the device includes a dispensing cap and/or tube having seams which are indicative of molded and heat welded sections. Thus, and, for example, FIGS. 1, 2 and 3, there is shown dispensing cap 1, upper cap section 19 and lower cap section 21. While this is not an essential feature of the invention, it does show how a dispensing cap or other device of the present invention may be constructed.

Referring again to FIGS. 2, 3 and 4, dispensing cap 1 has, on its lower cap section 21, a razor nest 7 as well a razor handle nest 35 and razor handle holder 9 (left side) and 31 (right side). Also, although not a critical feature of the invention, a hollow space 29 is shown in FIG. 2 merely to illustrate the savings of plastic materials in the construction of dispensing cap 1.

Basically, as mentioned above, the particular combination of dispensing cap 1 and tube 11 shown in FIG. 1 is operable merely by squeezing. Thus, the shaving lubricant passes through the dispensing cap 1 and specifically lubricant dispensing channel port 27 and is applied directly to the blade of a razor. In an alternative embodiment, some control mechanism may be used to prevent inadvertent dispensing of shaving lubricant. Although the present invention is not limited to a single example, one example of such an arrangement is shown in conjunction with FIGS. 5, 6 and 7.

Figure 5:
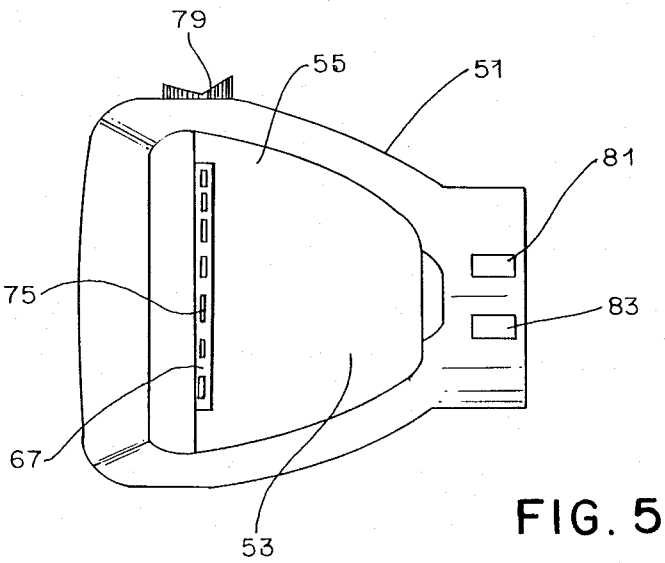
FIGS. 5 and 6 show a top view a cut side view of an alternative embodiment of a present invention dispensing cap and FIG. 7 shows a slider gate therefrom.
Figure 7:
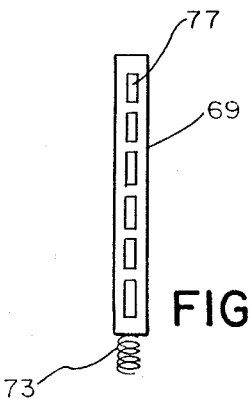
Figure 6:
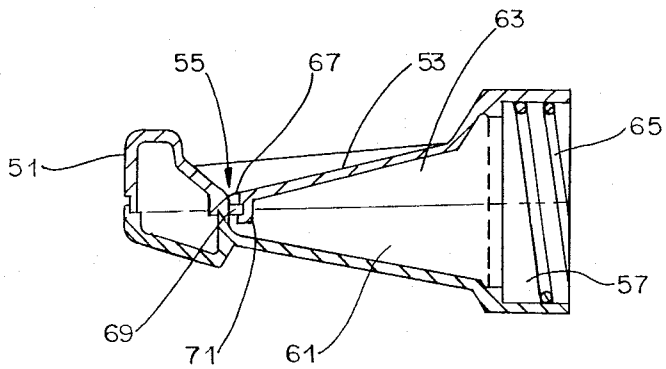

Referring now to FIGS. 5, 6 and 7, there is shown a dispensing cap 51 having a recessed tray 33 as well as a razor receiving portion 55 of recessed tray 53. Dispensing cap 51 also has a lubricant inlet channel 57 and has attachment means which, again in this case, are threads 65. There is also included a dispensing manifold 67 which, as shown in FIG. 5 in the top view, has a series of orifices. Slider gate 69 is strategically located under dispensing manifold 67 and held in place by slider gate support 71. Spring 73 biases slider gate 69 to a button 79 which may be used to push slider gate 69 so that its orifices 77 align with manifold 69 to either open or close the manifold for dispensing of shaving lubricant when dispensing cap 51 is attached to a shaving lubricant tube. The dispensing cap 51 shown in FIGS. 5 and 6 and its slider shown in FIG. 7 may be made of molded plastic and dispensing cap 41 may be molded in the form of a lower section 61 and an upper section 63. Spring 73 may be molded right into slider gate 69 to simplify its design.

Figure 8:
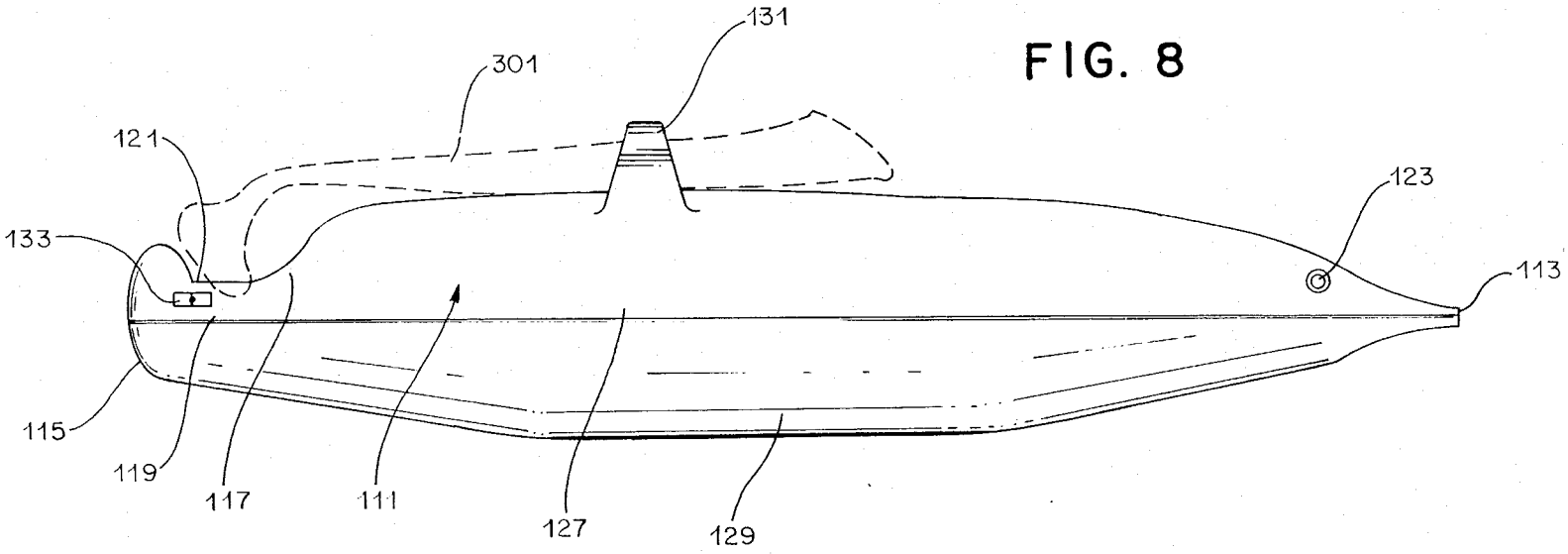
FIG. 8 sets forth a side view of an integral shaving lubricant tube having a dispensing cap built in but otherwise which functions as those shown in FIGS. 1 through 3; and, FIG. 9 illustrates a cut side view of the fill cap feature of the present invention device of FIG. 8.
Figure 9:
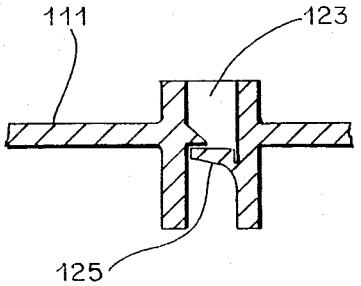

Referring now to FIGS. 8 and 9, there is shown a side view of a flexible shaving lubricant tube 111 which has integrated therein a dispensing cap portion 117 at its tube top end 115. Also, located at tube bottom end 113 is fill valve port 123 which is shown in greater detail in FIG. 9 in a side cut view and includes one-way flap valve 125, as shown. Dispensing cap portion 117 includes neck 119 and recess tay 121 and has functional aspects including a dispensing manifold (not shown) and has a two-way button 133 similar to button 79 in FIG. 5. Optional razor holder 131 is shown along with dotted line razor 301 nested therein. The combination of a unistructural shaving lubricant tube having an integral dispensing cap portion such as is shown in FIG. 8 may be modified without exceeding the scope of the present invention. For example, the tube bottom end 113, instead of having fill valve port 123, could have conventional threading and a conventional cap without exceeding the scope of the present invention.

Obviously, numerous modifications and variations of the present invention are possible in light of the above teachings. It is therefore understood that within the scope of the appended claims, the invention may be practiced otherwise than as specifically described herein.

What is claimed is:

1. A dispensing cap for shaving lubricant, which comprises:

(a) a neck having attachment means adapted for connection to the open end of a tube of shaving lubricant, said neck also having a channel through which shaving lubricant may pass from said tube to a receiving head on said cap; and, (b) a receiving head on said cap opposite said neck, said receiving head having:

i. an inside hollow area connected to the channel of said neck and adapted to receive a supply of shaving lubricant;

ii. an outside, recessed tray having a width greater than the width of a razor adapted receive at least the blade end of a razor; and, iii. a lubricant distribution means adapted to distribute lubricant from a supply of lubricant of the inside hollow area, including a manifold located at the blade end receiving portion of said recessed tray.

2. The dispensing cap of claim 1, wherein said attachment means is threading.

3. The dispensing cap of claim 1 wherein the lubricant distribution means includes at least one orifice through which shaving lubricant may pass to said tray to a razor at the blade end in response to squeezing of an attached tube of shaving lubricant.

4. The dispersing cap of claim 1 wherein the lubricant distribution means includes a manually operated open-close manifold slider gate for a user to dispense shaving lubricant from an attached tube.

5. A combination shaving lubricant tube and dispensing cap, which comprises:

(A) a dispensing cap, having:

(a) a neck having attachment means adapted for connection to the open end of a tube of shaving lubricant, said neck also having a channel through which shaving lubricant may pass from said tube to a receiving head on said cap; and, (b) a receiving head on said cap opposite said neck, said receiving head having:

i. an inside hollow area connected to the channel of said neck and adapted to receive a supply of shaving lubricant;

ii. an outside, recessed tray having a width greater than the width of a razor adapted to receive at least the blade end of a razor; and, iii. a lubricant distribution means adapted to distribute lubricant from a supply of lubricant of the inside hollow area, including a manifold located at the blade end receiving portion of said recessed tray; and, (B) a shaving lubricant tube connected to the neck of said cap.

6. The combination tube and dispensing cap of claim 5, wherein said attachment means is threading.

7. The combination tube and dispensing cap of claim 5, wherein the lubricant distribution means includes at least one orifice through which shaving lubricant may pass to said tray to a razor at the blade end in response to squeezing of an attached tube of shaving lubricant.

8. The combination tube and dispensing cap of claim 5 wherein the lubricant distribution means includes a manually operated open-closed manifold slider gate for a user to dispense shaving lubricant from an attached tube.

9. A shaving lubricant dispensing tube device, comprising:

a tube having a flexible body for containing shaving lubricant, said tube having a bottom end and a top end, a dispensing cap portion permanently affixed to said tube and located at said top end, said dispensing cap portion including:

(a) a neck having a channel through which shaving lubricant may pass from the body of said tube to a receiving head on said cap; and, (b) a receiving head on said cap opposite said neck, said receiving head having:

i. an inside hollow area connected to the channel of said neck and adapted to receive a supply of shaving lubricant;

ii. an outside, recessed tray having a width greater than the width of a razor adapted to receive at least the blade end of a razor; and, iii. a lubricant distribution means adapted to distribute lubricant from a supply of lubricant of the inside hollow area, including a manifold located at the blade end receiving portion of said recessed tray.

10. The shaving lubricant dispensing tube of claim 9 wherein the lubricant distribution means includes at least one orifice through, which shaving lubricant may pass to said tray to a nested razor at the blade end in response to squeezing of an attached tube of shaving lubricant.

11. The shaving lubricant dispensing tube of claim 9 wherein the lubricant distribution means includes a manually operated open-close manifold slider gate for a user to dispense shaving lubricant from an attached tube.

12. The dispensing cap of claim 1 which further comprises:

(c) a recessed area for storing a razor located on said cap which has width greater than the width of a razor at its blade end; and, (d) engaging-dispensing holding means for securing the handle of a razor to said cap while the blade end of said razor is nested in said recessed area.

13. The dispensing cap of claim 4 which further comprises:

(c) a recessed area for storing a razor located on said cap which has a width greater than the width of a razor at its blade end; and, (d) engaging-disengaging holding means for securing the handle of a razor to said cap while the blade end of said razor is nested in said recessed area.

14. The combination tube and dispensing cap of claim 4 wherein said cap further comprises:

(c) a recessed area for storing a razor located on said cap which has a width greater than the width of a razor at its blade end; and, (d) engaging-disengaging holding means for securing the handle of a razor to said cap while the blade end of said razor is nested in said recessed area.

15. The combination tube and dispensing cap of claim 8 wherein said cap further comprises:

(c) a recessed area for storing a razor located on said cap which has a width greater than the width of a razor at its blade end; and, (d) engaging-disengaging holding means for securing the handle of a razor to said cap while the blade end of said razor is nested in said recessed area.

16. The shaving lubricant dispensing tube of claim 9 is further comprising:

(c) a recessed area for storing a razor located on said tube which has a width greater than the width of a razor at its blade end; and, (d) engaging-disengaging holding means for securing the handle of a razor to said tube while the blade end of said razor is nested in said recessed area.

* * * * *